United States Patent [19]

Thomas et al.

[11] 4,058,318

[45] Nov. 15, 1977

[54] MULTI-PLAYER BACKGAMMON

[76] Inventors: Robert Melvin Thomas, 43 E. Edsall Blvd., Palisades Park, N.J. 07650; Robert Edward Thomas, 222 Lakeside Drive, Hopatcong, N.J. 07843

[21] Appl. No.: 685,586

[22] Filed: May 12, 1976

[51] Int. Cl.[2] ..... A63F 3/02

[52] U.S. Cl. ..... 273/134 AD; 273/134 D; 273/134 G

[58] Field of Search ..... 273/134, 136

[56] References Cited

U.S. PATENT DOCUMENTS

| | | | |
|---|---|---|---|
| 1,554,094 | 9/1925 | Huff et al. | 273/131 K |
| D. 85,066 | 9/1931 | Sternau | 273/134 G X |

FOREIGN PATENT DOCUMENTS

| | | | |
|---|---|---|---|
| 401,042 | 7/1909 | France | 273/134 G |

*Primary Examiner*—Delbert B. Lowe

*Attorney, Agent, or Firm*—Lawrence Rosen; E. Janet Berry

[57] ABSTRACT

A backgammon game board for simultneous play of at least three players. The game board is divided by transverse and longitudinal lines to provide eight adjoining boards, each of said boards including six points. Each player has a pair of said boards and color coded playing pieces. The complete board contains forty-eight playing points, and each player moves his playing pieces through both his pair of boards and those of an opponent.

8 Claims, 3 Drawing Figures

MULTI-PLAYER BACKGAMMON

BACKGROUND OF THE INVENTION

The invention is in the field of amusement devices.

THE PRIOR ART

The game of backgammon has been played for centuries by two players, using a playing board of 24 points over which each player moves 15 counters or men. The movement of one player's counters is in counter-flow direction to the movement of his opponent's counters, thus affecting and blocking the movements by his opponent. Because the moves of the men are determined by the throw of two dice, strategy in the game, and much of its appeal, is based upon ability to determine odds and to adjust play accordingly. Heretofore, backgammon normally has been restricted to two players. An adaptation known as chouette as played by three or more players recognizes the social value of enlarging the play to include more than two players. In chouette, however, each of the players are not of equal status, since one player plays against the combined strategy of the remaining players who act as a team with one of them selected as captain to make the final decision and moves.

SUMMARY OF THE INVENTION

The present invention may be summarized as a method of allowing four players, in partnerships of two, or individually, or three players individually, to oppose each other under standard backgammon forms of play, with each of the players being equal in play and decision making. The principal advance of the invention relates to the playing board which is composed of 48 points as opposed to 24 points found in standard backgammon. The points on the playing field are so laid out and movement of men through the points is so directed that each player opposes at least two opponents in his play, affects their play, and has his own play in turn affected similarly. It transfers the standard methodology of backgammon play into a game involving each player, either individually or as a partner.

An objective of the invention is to allow those familiar with standard backgammon to easily visualize the movement and opening position of men, so as to properly employ strategies of backgammon in their offense and defense.

A principal objective of the invention is to allow interaction of the play of any one player with two others, and, in the case of partnership play, with both opponents simultaneously.

A further objective of the invention is to allow standard and new forms of strategy to be employed by either a partnership, or two individuals acting in conjunction, to oppose the movement of one opponent simultaneously.

Another objective of the invention is to allow identical paths of play to be maintained as in backgammon without change in the standard backgammon rules governing the movement of men, the use of occupied points, the lifting off of opponent's men, re-entering the opponent's inner board, bearing off from a player's home board, and the use of the dice.

Another objective of the game is to retain the strategic leeway granted in standard backgammon for determining the value of the game in play, as that game continues in play.

A further objective of the game is to cause each individual of a partnership to play in a manner which will support his partner's play against the opponents and will not adversely hinder his partner's play.

It is also an objective of the invention to provide a game board which, by the choice of the players, can be used to achieve individual play against each of the other players or against only two of three opponents.

To attain these objectives, and such further objectives as may appear herein or be hereinafter pointed out, reference is made to accompanying drawings, forming a part hereof, in which.

Figure 1:
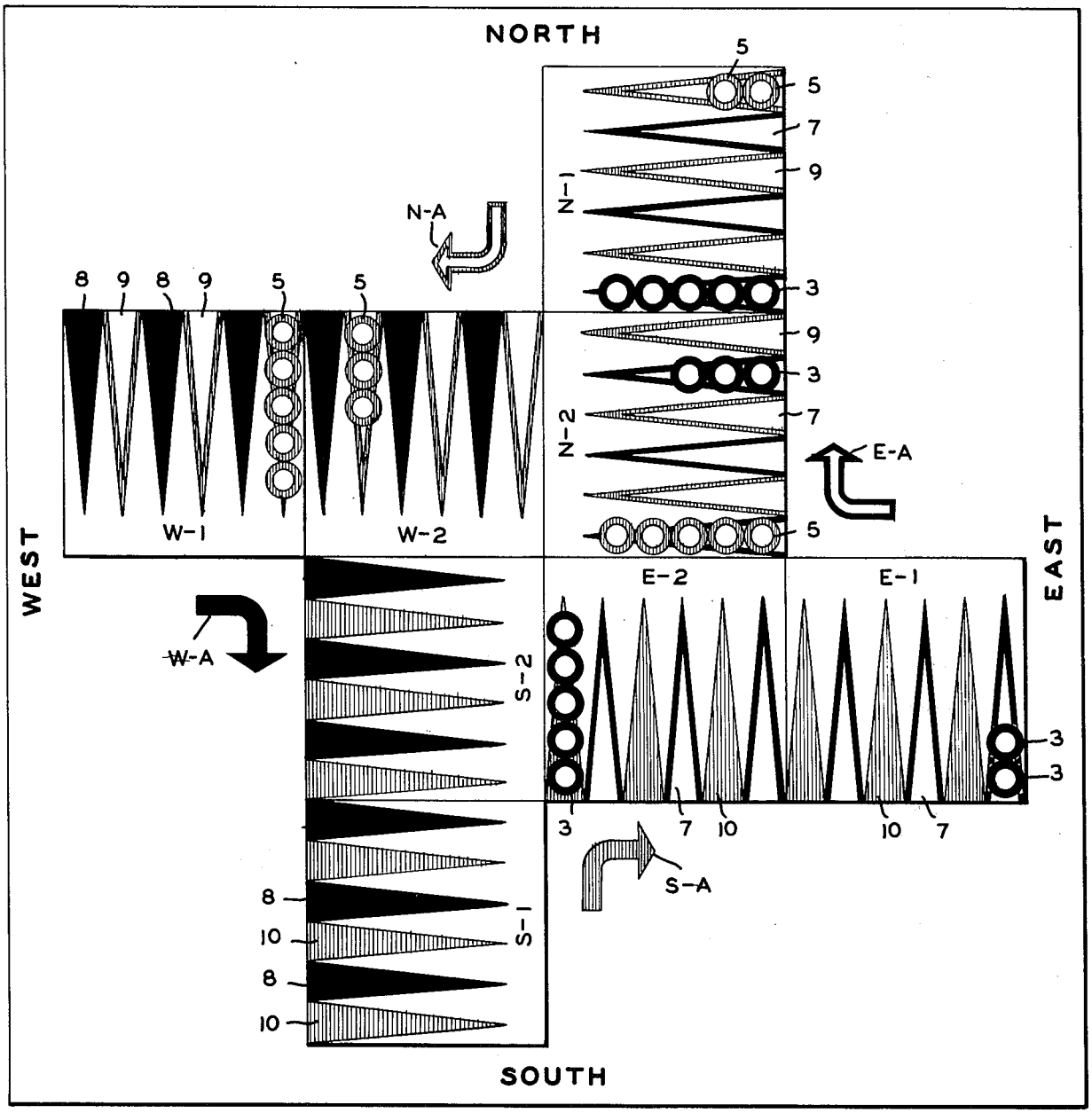
FIG. 1 is a plan view of the multi-player backgammon game board containing 48 points in accord with the invention.
Figure 2:
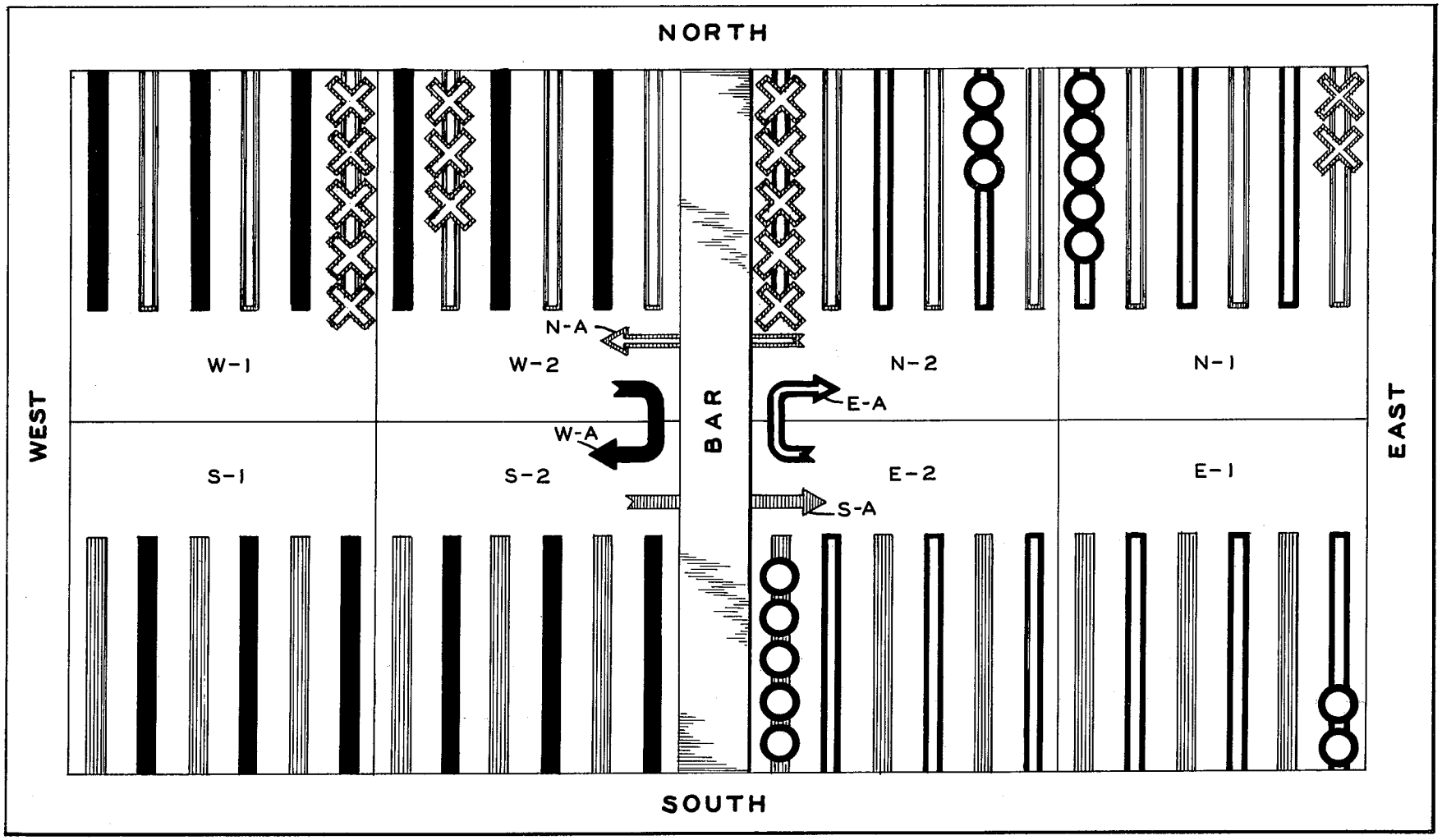
FIG. 2 is a plan view of a geometrical variation of the multi-player backgammon game board also containing the required 48 points.

It is obvious by reference to FIGS. 1 and 2 that both game boards permit the achievement of multi-player backgammon objectives. The symmetry of the FIG. 1 game board is preferred, since each player is facing an identical board and no advantage is gained by any player through choice of seating position. However, the game board of FIG. 2 has an advantage in its clarity and conservation of space, permitting the construction of larger playing areas within the board. For reference convenience, the playing areas, commonly called boards in standard backgammon, are numbered S-1, S-2, E-1, E-2, N-1, N-2, W-1 and W-2, with each number referring to an identical board in FIGS. 1 and 2. A description of the game board and its use follows.

FIG. 1 shows an arrangement of the eight playing boards. As in two-player backgammon, each player has an outer board and an inner or, as it is sometimes designated, a home board, as follows:

Board S-1 is West's inner board.
Board S-2 is West's outer board.

Board E-1 is South's inner board.
Board E-2 is South's outer board.

Board N-1 is East's inner board.
Board N-2 is East's outer board.

Board W-1 is North's inner board.
Board W-2 is North's outer board.

The play of the men for each player is as follows:

South's men flow from board S-1 through boards S-2, E-2 and E-1.

East's men flow from board E-1 through boards E-2, N-2 and N-1.

North's men flow from board N-1 through boards N-2, W-2 and W-1.

West's men flow from board W-1 through boards W-2, S-2 and S-1.

Figure 3:
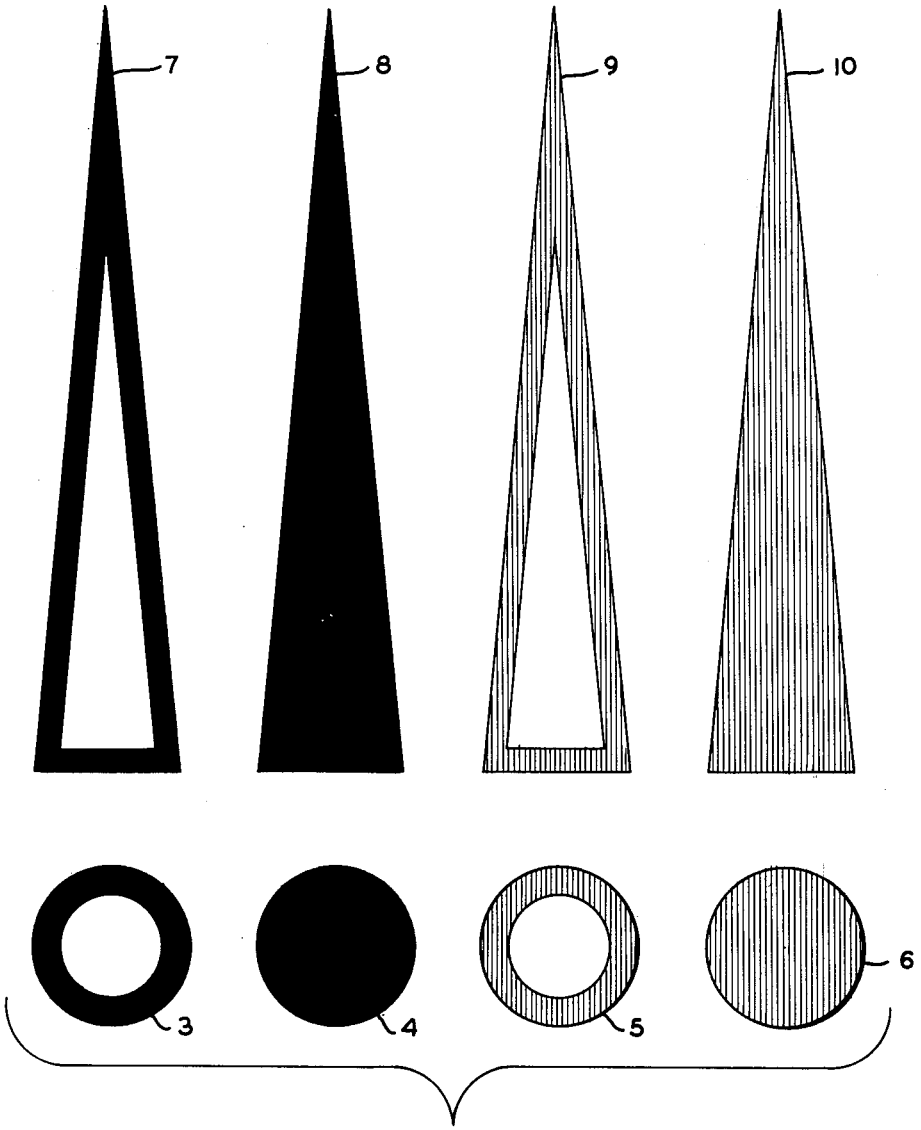
FIG. 3 is a plan view of the coding designation of the points and various counters, or men, which, in conjunction with FIGS. 1 and 2, will readily demonstrate the placement and movement of each player's counters.

FIG. 3 shows the coding used to identify and facilitate the flow of the men of each player through his playing boards. The counters and points used to direct the flow of the counters for each player are identified as 5 and 9 for North, 6 and 10 for South, 4 and 8 for West and 3 and 7 for East. The placement of the men at the start of the game is as in standard backgammon; This placement is shown in FIG. 1 with placement of the counters of the East and North players on playing boards E-1, E-2, N-1, N-2, W-1 and W-2. The placement of the counters of the West and South players is made in the same manner on Boards W-1, W-2, S-1, S-2, E-1 and E-2. It should be noted that the two men placed on the first point of the player's entering board are in coded agreement with the coding of this point. Thus, the two counters of North, Nos. 5, are positioned on a point coded No. 9, as an example.

Additional guides to the play pattern of each player's men can be put on the playing board, but are not essential to the invention. Examples of such additional guides are the directional arrows numbered S-A, E-A, N-A and W-A. These arrows can also be placed within the playing fields numbers S-2, E-2, N-2 and W-2.

As in backgammon, bars for holding counters which are borne off may be placed adjacent to boards S-1, E-1, N-1 and W-1. They are not essential to the play of the game board, FIG. 1. In FIG. 2 a bar is shown separating boards S-2, E-2, N-2 and W-2. While not essential, the placement of a bar as shown does aid in the visualization of the flow of the counters for East and West.

The object of the game is for the players to pass each of their counters to their inner board and to remove each of their counters from their inner board before the opponents have done the same. Rules regarding the movement of men, the use of occupied points, the lifting off of opponent's men, re-entering the opponent's inner board, bearing off from a player's home board, and the use of numbers obtained by throw of the dice follow the standard backgammon procedures as subscribed to by the International Backgammon Association, derived from those set down by the Backgammon and Cards Committee of the Racquet and Tennis Club of New York City in 1931. Additional rules to govern the play of more than two men as accomplished in multi-player backgammon have been formulated to achieve the full objectives of the invention and are set forth later in describing the various types of games that can be played with the multi-player backgammon game board.

FIG. 2 shows a second arrangement of the eight playing boards, which for reference convenience are numbered identically as in FIG. 1. The board designations and the play of the men for each player are the same as described for the FIG. 1 game board. The play of the men when considered as being governed by their starting placement in the standard backgammon game is demonstrated by the placement of North's and East's men in FIG. 2, in which the *x*'s designate North's men and the *o*'s designate East's men. By reference to the placement of the men, it is again readily apparent that there is no deviation from the accepted placement of men used in regular two-player backgammon.

It is also apparent that the placement and the flow of the men of each player accomplish an objective of multi-player backgammon, namely, each player plays his men against two of the opponents. In the partnership game, each partner plays his men through two of the board played by one of the partner's opponents and through two of the boards played by the other of the partner's opponents. The partner's men do not meet on a common board. When the game board is used for individual play of four players against each other, the absence of play of each man against one of the opponents introduces a new element of risk into the type of play of each man. The type of play chosen by a skilled player is often governed by the degree of skill o the player against whom he has no opportunity to play his men.

As in two-player backgammon, each board has six playing points. These are illustrated for convenience in FIG. 2 as rectangles. Varied geometrical configurations may be used, such as lines or diamonds. However, it is preferred, as in FIG. 1, to use the triangle points that have found common acceptance in backgammon. It is important, however, that the geometrical design used be identified by color coding or other means in such manner as to correspond to the same codings used to identify the men of the various players and that these codings are used to identify and facilitate the flow of the men of each player through his playing boards. As in backgammon, the alternate points are coded differently to facilitate counting. An additional objective in the multi-player backgammon game board is to use the alternate coding to identify the men of the two players who will pass through a given board. This coding speeds the play. It also facilitates the strategic play by making readily apparent the positions of the men of the players as they are proceeding through their boards in opposition to their opponents.

It is readily obvious that a simple coding using four different colors can be used, with two colors only appearing on any one board. Another variation is the use of two colors with white in which the men would be coded, for example, black, black-and-white, red and red-and-white. In this latter case, the triangle points would also be coded black, black-and-white, red and red-and-white. For convenience and ease of identification, the starting point of each player is coded identically with the identification code used for his men. For example, in FIGS. 1 and 2, the starting point in board S-1 holding two of South's men at the start would be coded solid red to correspond to the use of the solid red playing pieces. The alternate points proceeding through boards S-1, S-2, E-2 and E-1 could also be coded solid red. East's starting point on board E-1 would be coded black-white to correspond with the use of the black-white men, and the alternate points proceeding through boards E-1, E-2, N-2 and N-1 would also be coded black-white. To help identification with his partner, it is preferable to code North's starting point red-and-white and West's starting point black. North would use the red-and-white men, and West would use the black men. FIG. 3 illustrates a typical coding for the men and points in accord with the description using black, black-and-white, red and red-and-white coding. Variations will be apparent to one skilled in the design art and their use comes within the scope of our invention.

It will be apparent to skilled backgammon players that a multi-player backgammon board can be assembled by placing two identical backgammon boards together. In this case the outer boards of the backgammon sets would be abutted. By coding two additional sets of men, play could then proceed using the flow of men as set forth in our inventon. It has been found, however, that without the use of identification coding of the men and the points as set forth earlier, the play of the game is slowed considerably and frequent mistakes are made. Furthermore, the strategic positions of the men at any given time are obscured, detracting from use of free employment of mathematical probabilities in deciding the movement of men in accord with the flow of the dice and limiting the use of skill in the play of the game. The use of inlays, therefore, is contemplated and covered by our invention, with such inlays being coded in accord with our invention and being used to cover the playing boards of two standard backgammon sets of being used in conjunction with identically coded playing men.

A three-player game may be played with the multi-player backgammon game board by covering the inner and outer boards of one player, for example, those of West. The play of the three players is as follows:

South's men flow from board S-1 through boards S-2, E-2 and E-1.

East's men flow from board E-1 through boards E-2, N-2 and N-1.

North's men flow from board N-1 through boards N-2, S-2 and S-1.

Boards W-1 and W-2 are covered. The game board plan in FIG. 2 is particularly advantageous for following the flow of play in the three-player game.

The multi-player backgammon game board is also adaptable to play of an extended game in which each of the players passes his men through six playing boards and encounters each of the other players on at least two of the playing boards. This is particularly advantageous when four players are playing individually against each other in a gambling game. The play of the counters for each player then is as follows:

South's men flow from board S-1 through boards S-2, W-2, N-2, E-2 and E-1.

East's men flow from board E-1 through boards E-2, N-2, W-2, S-2 and S-1.

North-3 s men flow from board N-1 through boards N-2, E-2, S-2, W-2 and W-1.

West's men flow from board W-1 through boards W-2, S-2, E-2, N-2 and N-1.

Each of the players pass through 36 of the points on the game board. The game board of FIG. 1 is advantageous for this variation.

SUGGESTED RULES OF PLAY

From the foregoing description it will be evident that partnership backgammon and other variants described may be effected with a minimum of modification of the conventional rules of the standard game of two-player backgammon. Increased possibilities in scoring, doubling, playing of the men in partnership or individually, and continuing of play after one of the players has removed all of his counters result from the play of three or more players. Rules governing the resultant situations are set forth to achieve the objectives of the invention. In each of the described variants which follow, the play may be either clockwise or counter-clockwise, although clockwise play of the players in turn is preferred.

PARTNERSHIP BACKGAMMON

1. The game is played by four people, divided into opposing teams. Partners face each other across opposite sides of the board.

2. The object of the game is for both players of a partnership to pass each of their men to their inner board and to remove each of their men from the inner board before the opponents have done the same.

3. For the opening move, each player throws one die. The player with the highest number begins play by using the numbers thrown by himself and his partner. When the highest number is thrown by both partners, the partners select which player makes the first move. When the highest number is thrown by two players, one from each partnership, the highest partnership total determines the partnership making the first move. When the partnerships roll identical sets of dice, the value of the game is doubled, and the dice are recast to determine the first move.

4. After a player has borne off all fifteen of his counters, he uses any remaining die or complete turns to move the partner's counters not yet borne off.

5. When both partners have borne off all counters, the game is won at the pre-set value agreed upon before play.

If both partners have borne off all men before *one* of the opponents has borne off *any* men, the value of the game is doubled.

If both partners have borne off all men before *both* of the opponents have borne off *any* men, the value of the game is tripled, and If both partners have borne off all men before *both* opponents have borne off *any* men, and while one or more of the opponent's men remains on the inner board of one of the winning partners or is awaiting entry to such board, the value of the game is quadrupled.

6. The value of the game may be doubled during the play of the game by only one player from each partnership, predesignated as the "doubler" for his team. The other doubling conventions of two-player backgammon are retained.

INDIVIDUAL PLAY OF FOUR PLAYERS

Rules for the partnership game apply with the following changes:

1. The game is played by four persons, each opposing the other three players. Alliances may be made and broken during the game; an alliance is not binding upon subsequent play.

2. The object of the game is for one person to remove all his men from the inner board before any other player does the same.

3. For the opening move, each player throws one die. Ties involving the highest number are rethrown by the players involved. The player with the highest number begins by rethrowing two dice.

4. Scoring Rules:

The player who first bears off all of his counters wins the game at the preset game value against each of the opponents in turn.

If an opponent has failed to bear off any men, the value of the game against that opponent is doubled.

If an opponent has failed to bear off any men and has one or more men in the opponent's inner board or awaiting re-entry into the inner board, the value of the game against that opponent is tripled.

5. The value of the game is not doubled when a tie of the highest number is thrown at the start of the game.

6. The value of the game may be doubled during the play of the game by any player, but the player may not double again until each of the opponents still in play has doubled in turn. Each opponent may accept the double and remain in play or concede the double value of the game and withdraw from play. The counters of each player who withdraws from the game remain on the board and retain the same effect upon subsequent play as though the player were still playing. It is optional with the players whether or not the player whose double removes a man from the game has the right to land his counters on point(s) guarded by counters of the player not accepting the double.

INDIVIDUAL PLAY OF THREE PLAYERS

Rules for the game for individual play of four players govern.

What is claimed is:

1. A multi-player backgammon game board having the rectangular configuration of FIG. 1 of the drawings and having on its surface the eight board pattern shown in said FIG. 1.

2. A multi-player backgammon game board having the rectangular configuration of FIG. 2 of the drawings and having on its surface the eight board pattern shown in said FIG. 2.

3. A multi-player backgammon game board for the play of at least three players, said game board consisting of forty-eight playing points contained in eight boards of six playing points each, wherein the boards are aligned in relation to each other to allow each player to move his playing pieces through his two boards and through two other contiguous boards played by another player.

4. The multi-player backgammon game board of claim 3 wherein each of said players has outer and inner boards and all of said inner boards and all of said outer boards are concentrically disposed.

5. The multi-player backgammon game board of claim 3 in which alternate playing points of each playing board are coded differently to correspond to the coded playing pieces of two of the players.

6. The multi-player backgammon game board of claim 5 wherein the coding comprises four different colors.

7. The multi-player backgammon game board of claim 5 wherein the coding is by two colors, each of which is combined with a third color to give the required four codings.

8. The multi-player backgammon game board of claim 5 wherein the coding for each player is so arranged on the playing boards as to cause each player to move his playing pieces through his two playing boards and through two other boards used by another player.

* * * * *